US007168588B2

(12) United States Patent
Van Romer

(10) Patent No.: US 7,168,588 B2
(45) Date of Patent: Jan. 30, 2007

(54) MULTI-SECTION CONTAINMENT

(76) Inventor: Edward W. Van Romer, P.O. Box 687, Sandy Spring, SC (US) 29677

( * ) Notice: Subject to any disclaimer, the term of this patent is extended or adjusted under 35 U.S.C. 154(b) by 528 days.

(21) Appl. No.: 10/655,076

(22) Filed: Sep. 4, 2003

(65) Prior Publication Data

US 2005/0051547 A1 Mar. 10, 2005

(51) Int. Cl.
*B65D 25/04* (2006.01)

(52) U.S. Cl. ..... 220/571

(58) Field of Classification Search ..... 220/571, 220/507; 383/38, 104
See application file for complete search history.

(56) References Cited

U.S. PATENT DOCUMENTS 2,854,049 A 9/1958 Wylie
4,671,024 A 6/1987 Schumacher
5,090,588 A 2/1992 Van Romer
5,316,175 A 5/1994 Van Romer
5,423,339 A 6/1995 Latimer
5,429,437 A 7/1995 Shaw
5,762,233 A 6/1998 Van Romer
5,971,188 A * 10/1999 Kellogg et al. ..... 220/9.2
6,112,930 A 9/2000 McAtarian
RE37,924 E * 12/2002 Kellogg et al. ..... 220/9.2

* cited by examiner

*Primary Examiner*—Stephen Castellano
(74) *Attorney, Agent, or Firm*—McNair Law Firm, P.A.

(57) ABSTRACT

A multi-compartment portable containment structured positionable in an upstanding position providing multiple compartments for receiving contaminant and in a down position allowing said compartments to be folded into a compact condition for storage and transport.

16 Claims, 6 Drawing Sheets

Fig. 3
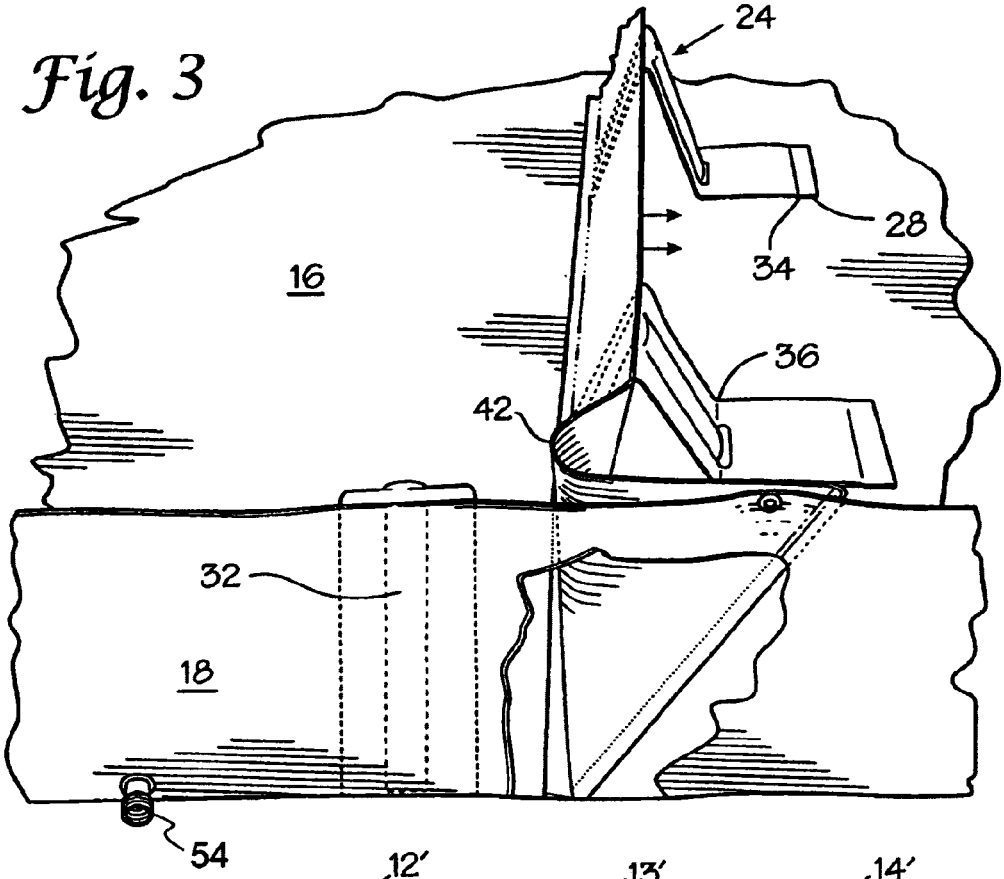
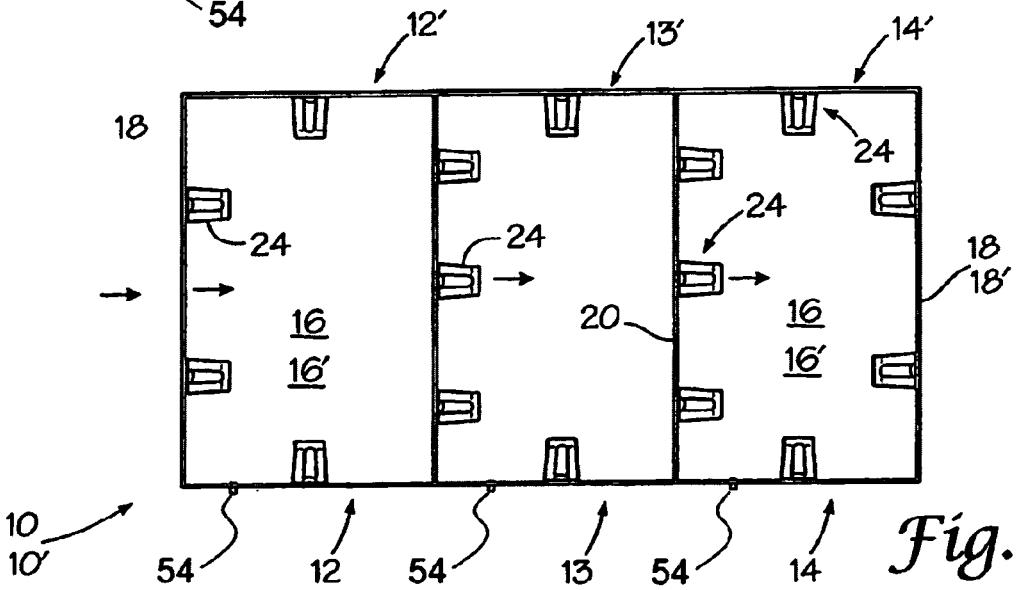
Fig. 4

MULTI-SECTION CONTAINMENT

BACKGROUND OF THE INVENTION

The instant invention is related to the decontamination process for people who have been subjected to contamination as a result of manmade or natural disasters. In the wake of such an event large numbers of people must be washed down to remove the contaminant. It is essential that this process occur very shortly after the disaster. It is equally important that the disaster not be compounded by further contaminating the ground soil and the water supply with the runoff from the wash down.

Normally, the wash down process occurs in a series of baths, usually at least three. In many instances, the wash down process occurs outside in open areas or in large warehouse type buildings. In either case containments for accumulating the liquid and preventing runoff must be provided.

Normally, wash down for the removal of contaminants is a multi-process procedure which includes at least three separate bath or shower areas. Such a process requires an individual containment for each phase of the wash down. In order to insure no spillage occurs as the individuals being decontaminated move between the baths, the containments must be arranged in substantially abutting positions or the plurality of containments must be placed in a very large containment.

This requires the use of a large number of containments which requires that a very large number of containments must be stored and shipped to the disaster area when a disaster occurs. Also, it is a time-consuming process to set up and arrange the containments in the above described manner.

Accordingly, it is an object of this invention to provide a multi-compartment containment.

It is another object of the invention to provide a multi-compartment containment which is easily folded for storage.

Another object of the invention is a containment for use after disasters which is easy to erect.

Another object of the invention is the provision of a multi-compartment containment which is easy to ship.

Finally, it is an object of the invention to provide a multi-compartment containment which eliminates spillage between compartments.

SUMMARY OF THE INVENTION

The above objectives are accomplished according to the invention by providing the multi-compartment foldable and portable containment for collecting contaminated fluid to include a flexible sheeting which forms a floor and a flexible sheeting connected with the floor adjacent its periphery forming exterior walls and defining an enclosed area. A plurality of flexible interior walls are each connected along a lower edge with the floor and at each end with an opposed pair of the exterior walls. The interior walls along with the exterior walls and the floor form a plurality of containment areas within the enclosed area.

A plurality of foldable braces are connected with the exterior walls. Each brace has an up position for maintaining the exterior walls in an upstanding position and a down position which allows the walls to lie on the floor. The interior walls include an interior support for maintaining them in an upstanding position when fluid is present in the containment areas. The interior wall support may constitute a foldable brace as discussed or the support may constitute a semi-rigid rod or elongate member arranged across the top edge of each interior wall. Alternatively, the interior support may comprise a flotation member arranged adjacent the top edge of each interior wall.

Each brace is formed to include a strap with one end connected adjacent an upper edge of the exterior wall and with its opposite end connected with the flooring. A rigid rod is carried in the strap between the floor and wall connections. The brace includes a second rigid rod carried by the exterior wall. A first hinge is provided adjacent the strap connection with the flooring, a second hinge is provided between a stiffened portion of the strap and the first rod and a third hinge is provided between the first and second rods. The straps may be connected with the flooring outside or inside the enclosed area.

Each containment area includes a drain member mounted in said exterior wall.

A multi-compartment foldable and portable containment for collecting contaminated fluid comprising:

(a) a flexible sheet shaped to form a plurality of interconnected compartments arranged along a linear axis;

(b) each compartment comprising a floor and a plurality of walls defining enclosed areas;

(c) a plurality of foldable braces connected with the outer walls having an upstanding position for maintaining the walls in a raised position and a down position for allowing the walls to lie on the floor;

(d) adjacent inner walls being connected along their upper edges joining the adjacent compartments while forming the multi-compartment containment; and (e) a support for maintaining the inner walls in a raised position or allowing them to be moved into a down position.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 3 is a cutaway perspective view of a first brace arrangement in the up position with an inner wall.

FIG. 4 is a top view of the multi-compartment containment of the invention.

DESCRIPTION OF A PREFERRED EMBODIMENT

Referring now in more detail to the drawings, the invention will now be described in more detail.

Figure 1:
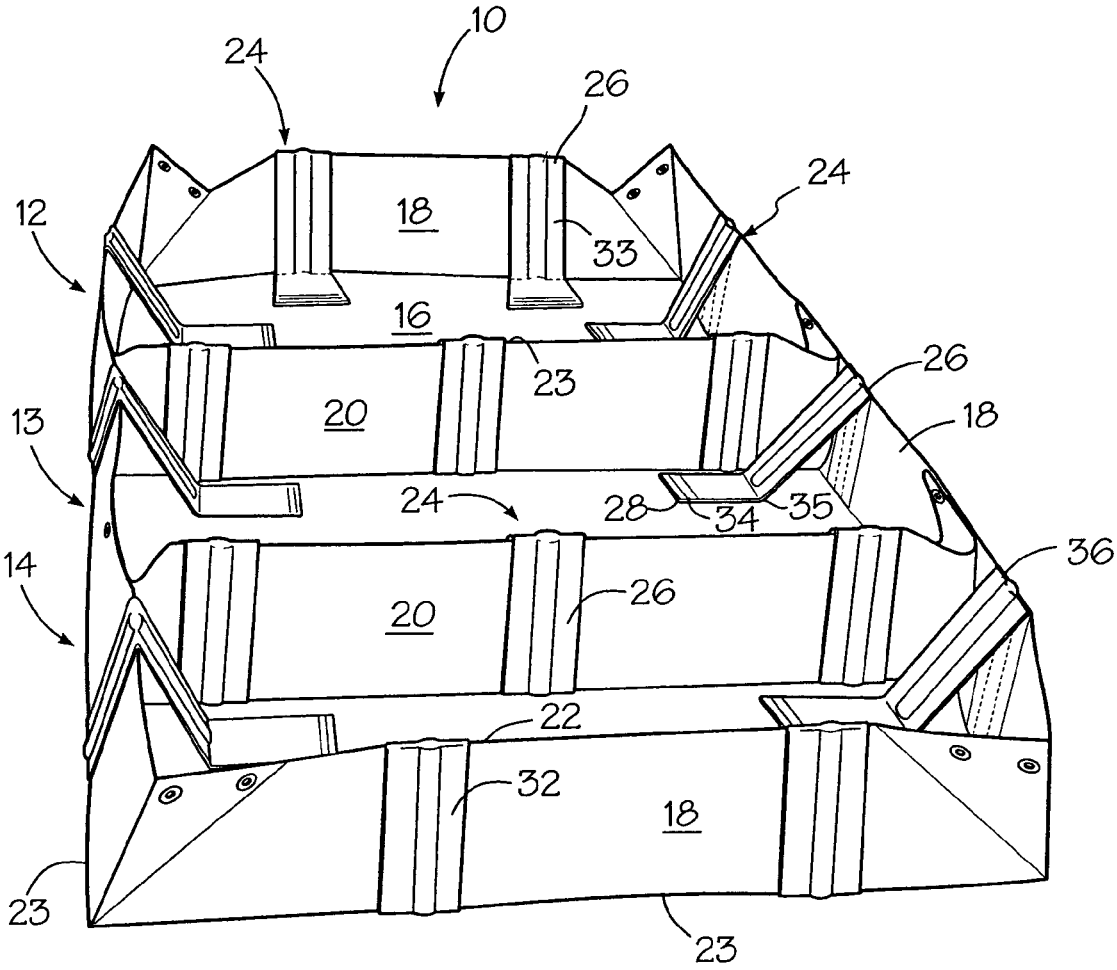
FIG. 1 is a perspective view of a first arrangement of the multi-compartment containment of the invention.
Figure 2:
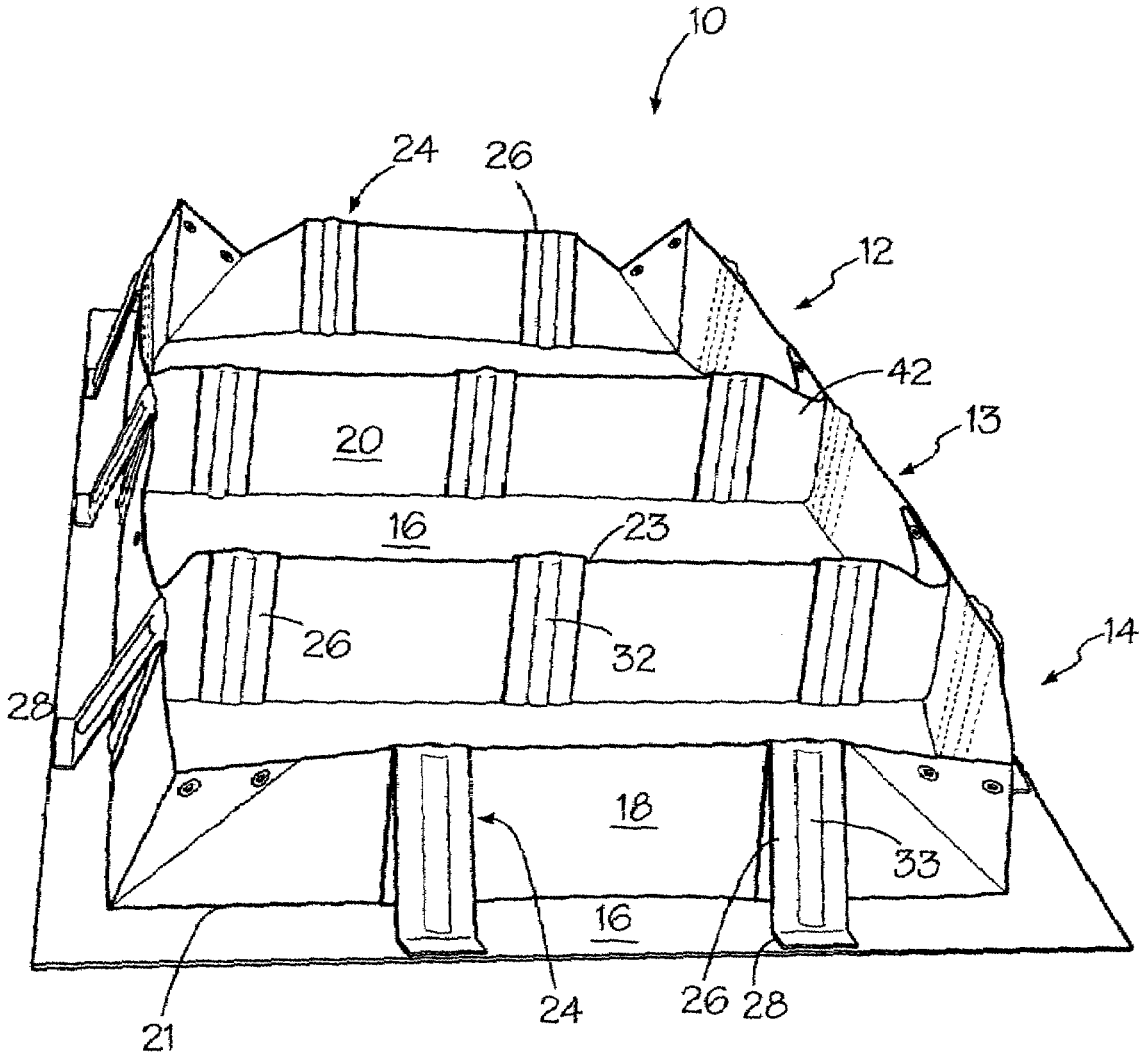
FIG. 2 is a perspective view similar to FIG. 1 showing a second arrangement of the invention.

Turning to FIGS. 1, 2 and 4, first and second arrangements of the multi-compartment containment are shown. Containment 10, in the shown arrangements, comprise three compartments or enclosed areas 12, 13 and 14 disposed in side-by-side sequence. Each containment 10 is formed of flexible synthetic sheeting and comprises floor 16, exterior walls 18 and interior walls 20. Preferably the flexible sheeting comprises a base fabric, woven or otherwise formed coated with a modified vinyl coating. Polyurethane is a preferred coating material although other synthetic materials which display the desired properties are suitable.

Exterior walls 18 may comprise a plurality of strips of flexible material joined at opposite ends or a single continuous strip of flexible material. The arrangements shown in FIG. 1 provides that exterior walls 18 are secured along their lower edge with floor 16 forming edge 23. Conversely the sheet forming floor 16 may extend beyond the desired interior size of the containment as shown in FIG. 2 with the lower edge of walls 18 secured with the upper surface of floor 16 forming edge 21 as shown in FIG. 2.

In each arrangement a plurality of foldable braces 24 are secured in spaced positions with exterior walls 18. Braces 24 are constructed to be positionable in an upright position for holding the exterior walls in an upstanding position in which the containment is configured to receive and hold contaminated fluid in the compartments as shown in FIGS. 1, 2 and 3.

Figure 5A:
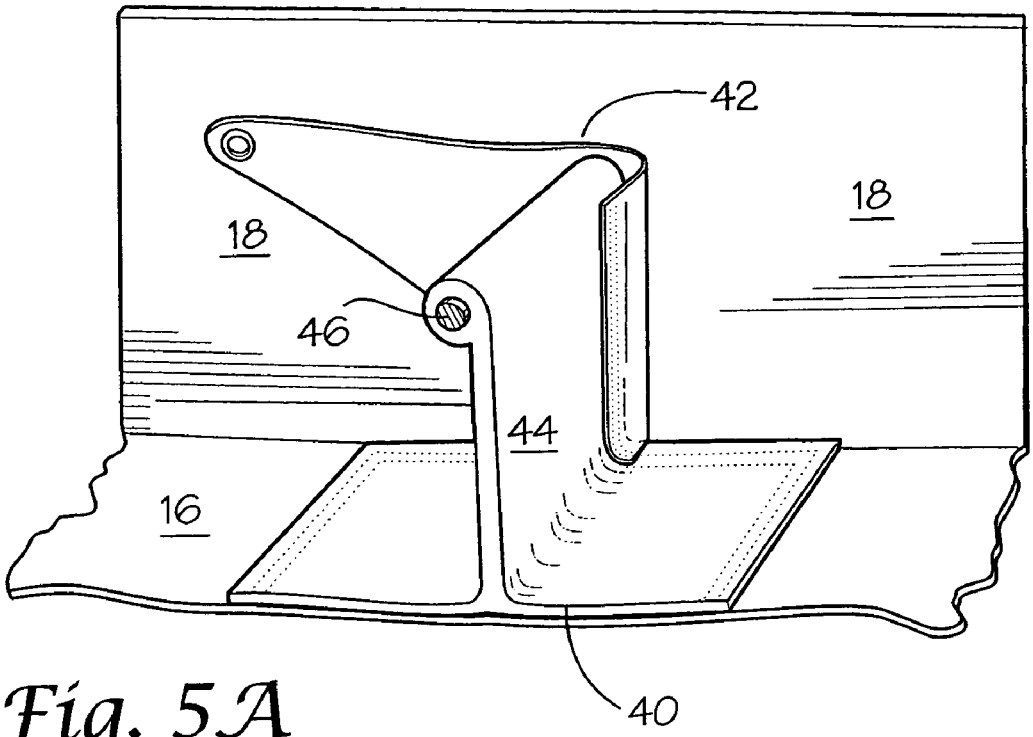
FIG. 5A is an exploded cutaway view of a second wall arrangement.
Figure 5B:
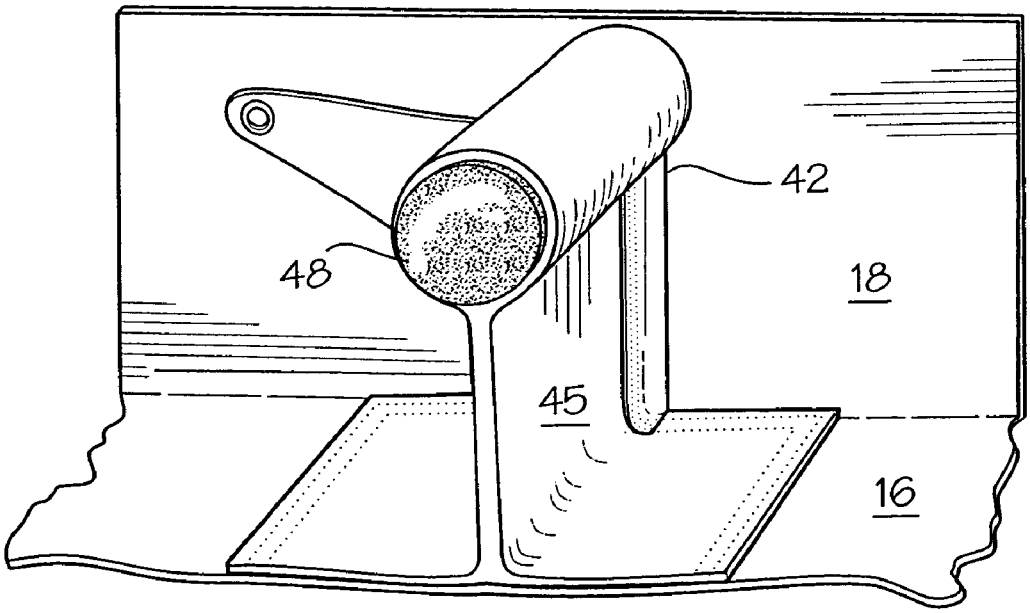
FIG. 5B is an exploded cutaway view of a third wall arrangement.
Figure 5C:
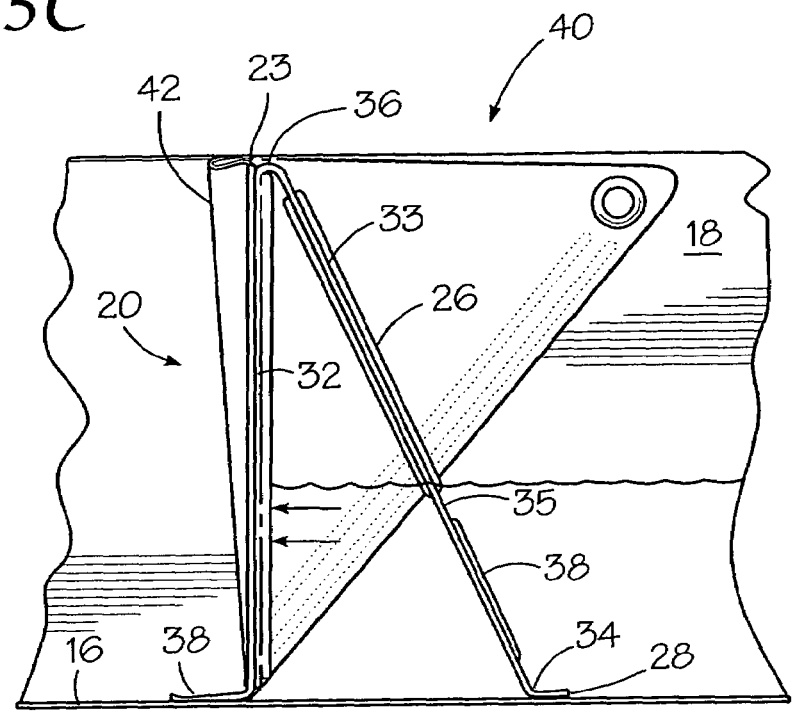
FIG. 5C is an exploded cutaway side view showing the first brace arrangement in the up position.
Figure 5D:
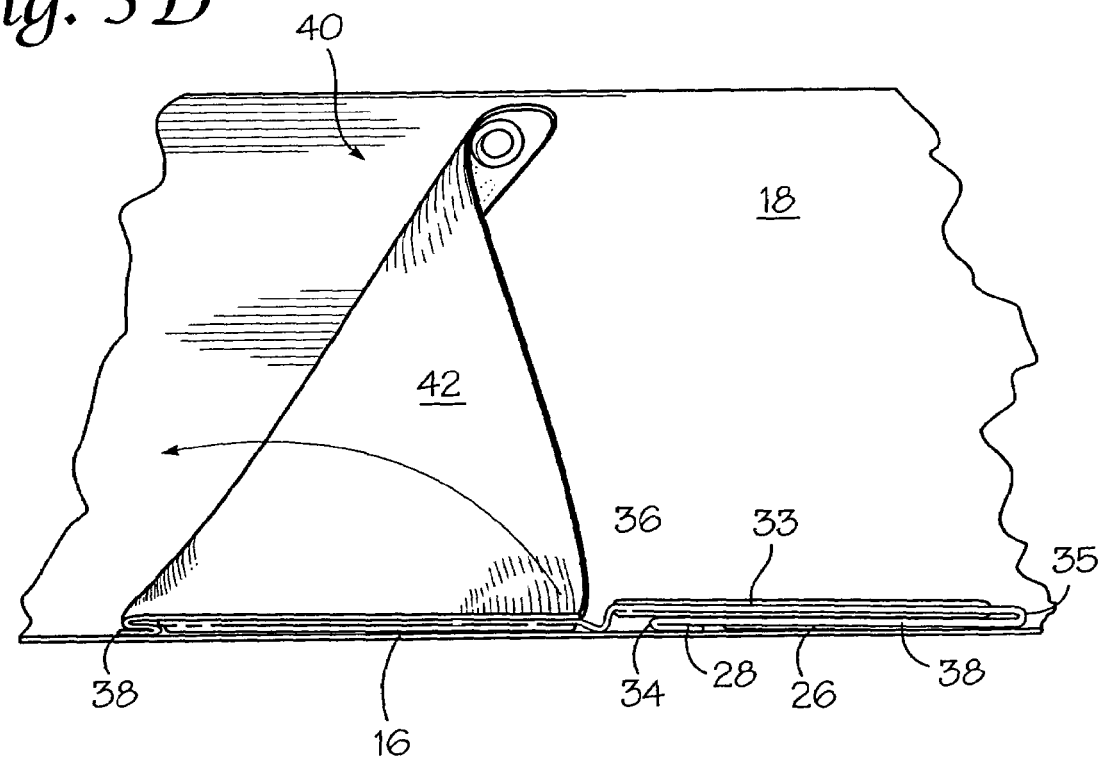
FIG. 5D is an exploded cutaway side view showing the first brace arrangement in the down position.

Braces 24 are also positionable in a down position, as shown in FIG. 5D, which allows the related wall portion to lie against floor 16. With the braces and walls in this position, the containment may easily be folded and placed in storage or loaded for transport. Braces 24 may also be connected with interior walls 20 as shown in FIGS. 1 and 2.

Brace 24 is more fully described in U.S. Pat. No. 5,316,175, the disclosure of which is incorporated herewith. Other suitable brace structures are shown in U.S. Pat. Nos. 5,090,588 and 5,762,233.

Each brace 24 comprises a strap 26 which connects with floor 16 at one end as shown at 28 and with wall 18 or 20 at its opposite end. As shown in FIGS. 1,2 the opposite end of strap 24 is connected adjacent the upper edge 22 or 23 of wall 18 or 20 and extends downward toward floor 16 forming a pocket 32 with wall 18 or 20. A rigid bar is carried in pocket 32 for assisting in maintaining wall 18 or 20 in the upright position. Strap 26 is structured to form a second pocket 33 which receives a second rigid bar which also assists in maintaining the walls in the upstanding position. Strap 26 includes a stiffened section 38 adjacent securement 28. Three hinges are formed along the length of strap 26 as best shown in FIGS. 5C and 5D. A first hinge 34 is located between floor connection 28 and stiffened section 38 of strap 26. A second hinge 35 is located between stiffened section 38 and pocket 33 and a third hinge 36 is located between pocket 33 and the top edge of the associated wall.

Exterior walls are generally formed to be about 8" high while interior walls are generally only about 4" high. These heights are not absolutes and can be varied as desired. The walls could be all one height.

Interior walls 20 are arranged perpendicularly of an opposed pair of exterior walls 18. The lower edge 38 of interior wall 20, as shown in FIGS. 5C and 5D is secured with floor 16 in any suitable manner preferably heat sealing. Opposed ends of interior walls 20 are preferably cut at about a 45° angle and are secured diagonally with the opposed exterior walls as shown at 40. This construction forms a flap 42 between the horizontal portion of the inner wall and the opposed exterior wall. Flap 42 provides an excess of material which allows the walls to be smoothly folded against floor 16.

Figure 6:
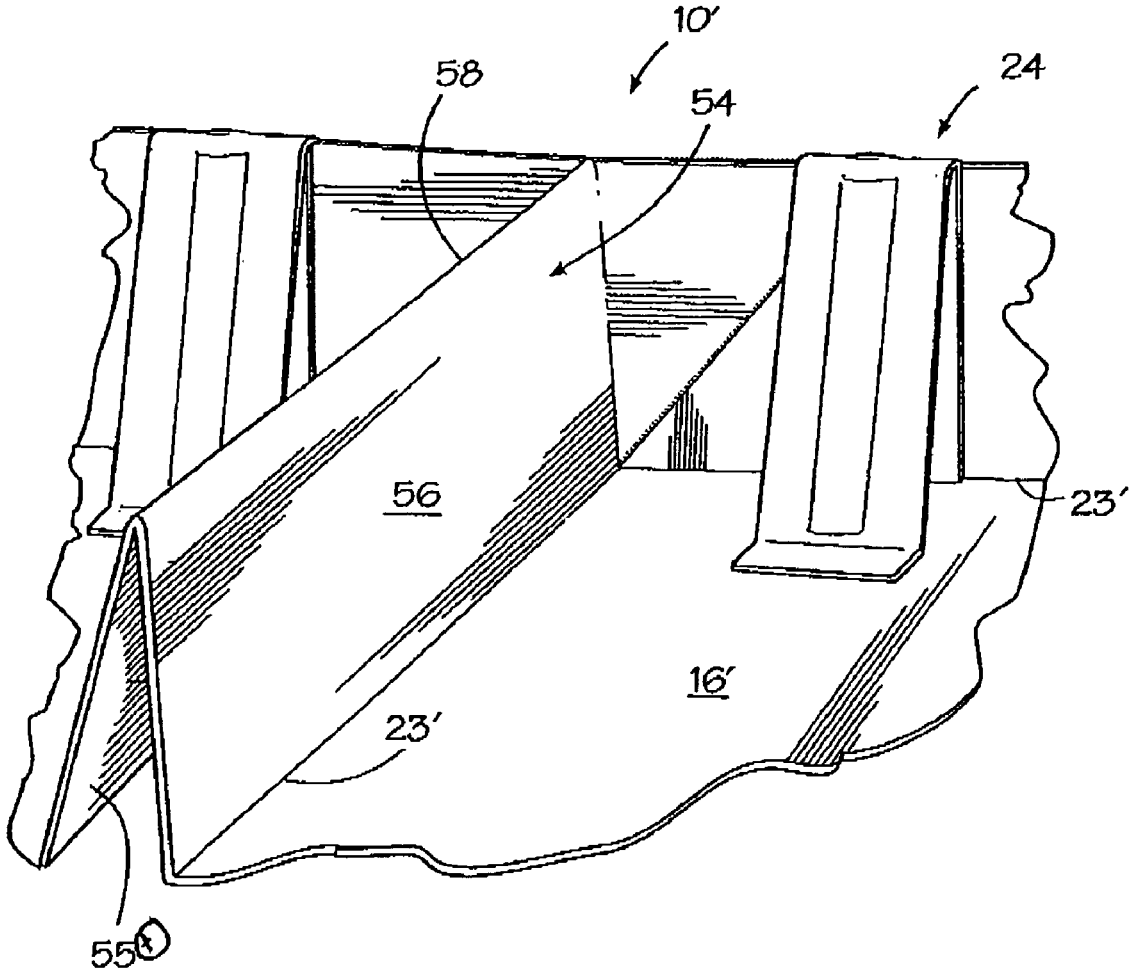
FIG. 6 is an exploded sectional view of a fourth wall arrangement.

The inner wall structure may be varied as illustrated in FIGS. 5A, 5B and 6. In FIGS. 5A and B inner walls 44 and 45 are formed with flap 42 at each end which secures the inner walls with an outer wall 18 in the manner earlier described above. Lower edge 40 of inner walls 44 and 45 is secured with floor 16 in any suitable manner, preferably by heat sealing.

Along the upper edge of wall 44 a semi-rigid rod 46 is secured by way of a suitable pocket. Rod 46 acts to prevent folds or crimps from forming along the length of the inner rod.

When the compartment begins to fill with fluid outer walls 18, which are in the upstanding position, are urged outward. This movement of the opposed outer walls applies a longitudinal pull on wall 44 which draws it into an upstanding position.

In the arrangement shown in FIG. 5B the upper portion of inner wall 45 is formed with a suitable pocket to receive a floatable foam material 48. Wall 45 also includes a flap 42 at each end which is connected with opposed outer walls as previously described. As the compartment fills with fluid the outward movement of the outer walls along with foam 18 causes wall 45 to assume the upstanding position.

The arrangement shown in FIG. 6 differs from the previously described arrangements with the inner wall structure. In this arrangement, also illustrated schematically in FIG. 4, containment 10' comprises a plurality of compartments 12', 13' and 14' which are formed with outer walls 18' connected with floor 16' along edges 23' and includes braces 24 as in the previously described arrangements. Inner wall 54 comprises first and second sections 55 and 56 connected along their upper edge forming hinge 58.

In the arrangement shown in FIG. 6, compartments 12', 13' and 14' are arranged along a longitudinal axis and are inter-engaged by hinges 58. Braces 24 are connected with and support exterior wall 18' in the upstanding position when the multi-compartment container is in its operative position as shown in FIG. 4.

In the inoperative position, braces 24 are positioned in the down position and compartment 12' is pivoted about hinge 58 over compartment 13'. During this movement inner wall 54 moves into position against floor 16. Compartment 14' is also folded about hinge 58 onto and over compartments 12' and 13'. The containment is now positioned for further folding.

FIG. 4 also illustrates containment 10 in its operative position with compartments 12, 13 and 14 in position to sequentially receive individually people to be decontaminated.

Decontamination begins with the contaminated person entering compartment 12, 12' in the direction of the arrow. Here a first wash down is performed. The person then proceeds to compartment 13, 13' where a second wash down is performed. Lastly, the person enters compartment 14, 14' where the final wash down occurs. It is noted more compartments may be added if desired.

A drain 54 is provided with each compartment, preferably in the lower edge of an exterior wall. The drains are designed to secure with hoses or other means to carry the contaminated fluid to a storage area for eventual disposal. Each compartment may be drained after each wash down or as necessary or desired.

While a preferred embodiment of the invention has been described using specific terms, such description is for illustrative purposes only, and it is to be understood that changes and variations may be made without departing from the spirit or scope of the following claims.

What is claimed is:

1. A multi-compartment containment positionable in a folded condition for storage and transport and an upstanding position for collecting contaminated fluid comprising;

a plurality of compartments arranged along a linear axis;

each said compartment comprising a floor and a plurality of outer and inner walls defining enclosed areas;

a plurality of foldable braces connected with said outer walls, said braces having an upstanding position for supporting said outer walls in a raised position when said containment is positioned in said upstanding position and a down position in which said outer ones of said walls are unsupported;

upper edges of adjacent of said inner walls being interconnected along their length upper edges thereof forming a hinge between adjacent of said compartments allowing said adjacent ones of said compartments to be positioned side by side in said upstanding position and folded onto each other into said folded position.

2. The containment of claim 1 wherein one of each of said adjacent of said inner walls includes a brace, said brace being positionable between an up position and a down position.

3. The containment of claim 1 including a drain in an outer wall of each said compartment.

4. A multi-compartment foldable and portable containment for collecting contaminated fluid comprising:

flexible sheeting forming a floor;

flexible sheeting forming exterior walls connected with said floor adjacent its periphery forming an enclosed area;

a plurality of flexible interior walls each connected along a lower edge with said floor and at each end with a pair of opposed of said exterior walls, said interior walls along with said exterior walls and said floor forming a plurality of containment areas within said enclosed area;

a plurality of foldable braces connected with said exterior walls and having an up position for maintaining said exterior walls in an upstanding position and a down position in which said walls lie on said floor;

said interior walls having an interior wall support for maintaining said interior walls in an upstanding position when fluid is in said containment areas; wherein, said multi-compartment containment may be folded into a compact generally flat configuration for storage and may be unfolded and spread into an expanded multi-compartment unit which said exterior and interior walls are maintained in an upright position forming said plurality of containment areas for containing said contaminated fluid.

5. The containment of claim 4 wherein said flexible sheeting comprises a base fabric coated with synthetic material.

6. The containment of claim 4 wherein each said brace includes a strap connected adjacent an upper edge of said exterior wall and with said floor and a rigid bar carried by said strap between said floor connection and said wall connection.

7. The containment of claim 6 wherein each said brace includes a second rigid bar carried by said exterior wall.

8. The containment of claim 6 wherein said strap connection with said floor is within said enclosed area.

9. The containment of claim 6 wherein said strap connection with said floor is outside said enclosed area.

10. The containment of claim 4 wherein said interior walls are of less height than said exterior walls.

11. The containment of claim 4 wherein said interior support comprises a plurality of foldable braces connected with said floor and upper portions of said interior walls.

12. The containment of claim 4 wherein said interior support comprises a semi-rigid rod connected with each said inner wall adjacent an upper edge.

13. The containment of claim 4 wherein said interior support comprises a flotation member arranged substantially along an upper edge of each said interior wall.

14. The containment of claim 4 wherein each said interior wall includes a flap connecting opposed ends of said interior wall with said exterior walls.

15. The containment of claim 14 wherein said connection between each said interior wall and said floor extends substantially perpendicularly of said opposed exterior walls and said flap connection with said opposed exterior walls is diagonal of said opposed exterior walls, said flap forming a fold between said end portions of said interior walls and said opposed exterior walls.

16. The containment of claim 4 wherein each said containment area includes a drain member in an exterior wall.

* * * * *